US006398854B1

(12) United States Patent
Aonuma

(10) Patent No.: US 6,398,854 B1
(45) Date of Patent: Jun. 4, 2002

(54) CHEMICAL SOLUTION FOR FORMING SILVER FILM AND PROCESS FOR FORMING SILVER FILM USING SAME

(75) Inventor: Hidenori Aonuma, Mie (JP)

(73) Assignee: Central Glass Company, Limited, Ube (JP)

( * ) Notice: Subject to any disclaimer, the term of this patent is extended or adjusted under 35 U.S.C. 154(b) by 0 days.

(21) Appl. No.: 09/501,576

(22) Filed: Feb. 10, 2000

(30) Foreign Application Priority Data

Feb. 10, 1999 (JP) ..... 11-032276

(51) Int. Cl.[7] ..... C23C 18/52; B05D 1/18

(52) U.S. Cl. ..... 106/1.19; 106/1.18; 106/1.23; 106/1.25; 427/443.1

(58) Field of Search ..... 106/1.18, 1.19, 106/1.23, 1.25; 427/443.1

(56) References Cited

U.S. PATENT DOCUMENTS

| | | | | | |
|---|---|---|---|---|---|
| 3,983,266 | A | * | 9/1976 | Bahls | 106/1.18 |
| 4,144,361 | A | * | 3/1979 | Feldstein | 427/162 |
| 4,737,188 | A | * | 4/1988 | Bahls | 106/1.19 |
| 5,514,261 | A | | 5/1996 | Herklotz et al. | 205/238 |
| 5,645,628 | A | * | 7/1997 | Endo et al. | 106/1.23 |
| 5,716,433 | A | * | 2/1998 | Aonuma et al. | 106/1.19 |
| 6,017,580 | A | * | 1/2000 | Soltys | 427/162 |
| 6,210,556 | B1 | * | 3/2001 | Toben et al. | 106/1.23 |

FOREIGN PATENT DOCUMENTS

| | | |
|---|---|---|
| JP | 8-27590 | 1/1996 |
| JP | 11-021693 | 1/1999 |
| JP | 2001-26898 | 1/2001 |

OTHER PUBLICATIONS

Derwent abstract of SU406959, May 1974.*

* cited by examiner

*Primary Examiner*—Helene Klemanski
(74) *Attorney, Agent, or Firm*—Crowell & Moring LLP

(57) ABSTRACT

The present invention relates to a chemical solution for forming a silver film on a substrate. This chemical solution has (1) an ammoniac silver nitrate solution; (2) a reducing solution containing a reducing agent and a base component; and (3) an additive containing a compound of a polyvalent metal. This additive is contained in at least one of the ammoniac silver nitrate solution and the reducing solution. The present invention further relates to a process for forming a silver film on a substrate, using the chemical solution. This process includes (a) bringing a hydrochloric acid acidified stannous chloride solution into contact with a surface of the substrate, thereby conducting a pretreatment of the surface; (b) bringing another ammoniac silver nitrate solution into contact with the surface of the substrate; and (c) bringing the ammoniac silver nitrate solution into contact with the reducing solution, on the surface of the substrate, thereby forming the silver film. It becomes possible to form a compact, uniform silver film with a high silver plating rate that allows the obtaining of high-resolution reflected images, excellent adhesion to a glass substrate, and improved corrosion resistance of the silver.

12 Claims, No Drawings

CHEMICAL SOLUTION FOR FORMING SILVER FILM AND PROCESS FOR FORMING SILVER FILM USING SAME

BACKGROUND OF THE INVENTION

The present invention relates to a chemical solution for forming a silver film by precipitating fine silver particles on a substrate such as glass, and in the case of production of a mirror by coating with a copper film and a corrosion-resistant resin film, forming the above-mentioned silver film finely, uniformly and with good plating efficiency and further relates to a process for forming a silver film using the chemical solution.

It is known to apply a conventional chemical solution for forming a silver film to a substrate and then allow the components of the solution to react. With this, silver is precipitated on the substrate to form a silver film. In fact, such chemical solution is a combination of (1) an ammoniac silver nitrate solution and (2) a reducing solution containing (a) a reducing agent, such as sodium gluconate, glucitol, D-glucose, tartaric acid or formaldehyde, and (b) a strong base component such as sodium hydroxide or potassium hydroxide. In the application, the ammoniac silver nitrate solution and the reducing solution are contacted on the substrate to generate the reaction.

However, in the case of simply bringing these components into contact and allowing them to react, the rate of silver plating is low, a silver film cannot be formed efficiently, and a compact, uniform silver film cannot be formed. In addition, since the resulting silver film is weakly adhered to a glass substrate and so forth, problems frequently occur in which the silver film separates and comes off of the glass substrate during edge machining and so forth of the mirror product. Moreover, in the case of immersing or allowing the resulting mirror in a corrosive solution or gas to investigate its corrosion resistance, or in the case of allowing to stand in ordinary air, the silver film is corroded in a relatively short period of time, thereby frequently resulting in the problem of it losing its function as a mirror.

SUMMARY OF THE INVENTION

It is an object of the present invention to provide a chemical solution for forming a silver film that is compact and uniform.

It is another object of the present invention to provide a process for forming such silver film using the chemical solution.

According to the present invention, there is provided a chemical solution for forming a silver film on a substrate. This chemical solution comprises (1) an ammoniac silver nitrate solution; (2) a reducing solution containing a reducing agent and a base component; and (3) an additive containing a compound of a polyvalent metal. This additive is contained in at least one of the ammoniac silver nitrate solution and the reducing solution.

According to the present invention, there is provided a process for forming a silver film on a substrate, using the chemical solution. This process comprises (a) bringing a hydrochloric acid acidified stannous chloride solution into contact with a surface of the substrate, thereby conducting a pretreatment of the surface; (b) bringing another ammoniac silver nitrate solution into contact with the surface of the substrate; and (c) bringing the ammoniac silver nitrate solution into contact with the reducing solution, on the surface of the substrate, thereby forming the silver film.

DESCRIPTION OF THE PREFERRED EMBODIMENTS

As will be clarified hereinafter, according to the present invention, effects are demonstrated that allow the formation of a compact, uniform silver film with a high silver plating rate that allows the obtaining of high-resolution reflected images, excellent adhesion to a glass substrate, and improved corrosion resistance of the silver.

The ammoniac silver nitrate solution in the chemical solution for forming a silver film refers to an aqueous solution containing therein silver nitrate and ammonium hydroxide, and is used as one of the two liquids of the chemical solution. The reducing solution of the chemical solution refers to an aqueous solution containing (1) a reducing agent, such as sodium gluconate, glucitol, D-glucose, tartaric acid or formaldehyde, and (2) a strong base component, such as sodium hydroxide or potassium hydroxide, and is used as the other liquid of the chemical solution. The chemical solution is a combination of the silver nitrate solution and the reducing solution and thus is a so-called two-package type solution. That is, the silver nitrate solution and the reducing solution of the chemical solution are brought into contact with each other on a substrate, thereby forming a silver film on the substrate. In fact, the silver nitrate solution and the reducing solution are simultaneously sprayed and mixed on a transported substrate, such as a transparent glass substrate, after which silver is precipitated by the reduction reaction resulting in the formation of a silver film on the substrate. Furthermore, a copper film is additionally formed on the silver film by a similar chemical plating during the course of mirror production, and the mirror is completed by applying a protective covering made of resin and so forth over that copper film.

In the prior art, however, since coagulated clumps of silver colloid (referred to as silver sludge) form in the solution during the course of the plating reaction, the silver plating rate decreases and a compact, uniform silver film cannot be efficiently formed as previously described. This is because, even though the silver colloid has a negative surface potential, this potential is extremely small. Moreover, since silver colloid is hydrophobic in aqueous solution, coagulated clumps form. With this, the specific surface area (surface energy) decreases, and coagulated clumps become stable. In contrast, the present invention provides the above-stated chemical solution and process that are effective in terms of uniformly and efficiently forming a silver film that has a high degree of adhesion to glass substrates and so forth, and has excellent corrosion resistance for use as a mirror product.

As stated above, at least one of the ammoniac silver nitrate solution and the reducing solution of the chemical solution contains an additive comprising a compound of a polyvalent metal, preferably having a valence of 3 or more, such as Bi(III), Al(III) or Fe(III). Thus, the additive may be this compound itself. This compound may be selected from sulfate, acetate, nitrate and other salts, chloride, bromide, fluoride and other halides, sulfide, hydroxide and so forth. Preferably, the use of the following metal compounds can be recommended.

In the present invention, examples of the metal compound containing Bi(III) include bismuth nitrate, bismuth acetate, bismuth hydroxide, bismuth carbonate, bismuth sulfate, bismuth sulfide, bismuth fluoride, bismuth chloride, bismuth bromide and bismuth iodide. These compounds form $Bi(OH)_3$ colloid in aqueous solution. This colloid has a strong positive surface potential, and produces an electrical attraction for silver colloid having a weak negative surface potential, causing it to be adsorbed onto the surface of silver colloid. Consequently, silver colloid becomes charged with the strong positive surface potential of $Bi(OH)_3$ colloid resulting in mutual electrical repulsion and inhibition of the formation of coagulated clumps. Examples of the metal compound containing Al(III) include aluminum sulfate, aluminum hydroxide and aluminum acetate. Examples of the metal compound containing Fe(III) include iron sulfate, iron hydroxide and iron acetate. These compounds form hydroxides having a valence of 3 or more, such as $Al(OH)_3$ and $Fe(OH)_3$, in aqueous solution and act in the same manner as the above-mentioned $Bi(OH)_3$. Furthermore, since these compounds are formed over a relatively narrow pH range in aqueous solution, caution may be required when preparing the solutions. Furthermore, these metal elements can be easily detected by fluorescent X-ray analysis or wet analysis and so forth of a mirror or silver film.

The concentration of silver nitrate in the silver nitrate solution is preferably within the range of 0.01 mol/liter to 1 mol/liter. Within this range, it is more preferably about 0.1 mol/liter. The amount of the additive in the silver nitrate solution and/or the reducing solution should be determined in consideration of the amount of the above-mentioned silver nitrate, and of the ratio of the silver nitrate solution to the reducing solution and so forth. The additive is in an amount preferably of from 5 to 100 mg relative to 0.1 mol of the silver nitrate. Furthermore, The addition of an excessive amount of the additive may result in problems including decreased plating efficiency and the formation of coagulated clumps that can cause a decrease in mirror quality.

Although the silver nitrate solution and the reducing solution are normally brought into contact and reacted on the substrate by using nearly equal amounts, there are no particular restrictions on ratio of the two solutions, and the ratio of the silver nitrate solution to the reducing solution may be, for example, from (1/2):1 to 1:(1/2).

Although the reaction time of the silver nitrate solution and the reducing solution is not particularly limited, it is typically from about 20 seconds to about 40 to 50 seconds, and the reaction is essentially completed during that time. In contrast with that plating efficiency (i.e., the amount of silver plated on the substrate per amount of silver supplied) is less than 40 wt % in the case of not using the additive in a silvering test, the use of the additive may result in this becoming 40 wt % or higher.

It is preferable to employ the following procedure as a suitable process for forming a silver film on a substrate using the chemical solution for forming a silver film of the present invention. Namely, the process first goes through a preliminary treatment step in which, after first cleaning the substrate, a hydrochloric acid acidified stannous chloride solution is brought into contact with a surface of a substrate. Then, another silver nitrate solution, which may be different from that of the chemical solution, is brought into contact with the surface of the substrate. In fact, the another silver nitrate solution is free of the additive, in contrast with that of the chemical solution. In contrast with the above description, the chemical solution of the invention may be defined as further comprising the another silver nitrate. The another silver nitrate solution may contain 1/100 to 1/10 the total amount of silver nitrate applied for plating. In other words, the silver nitrate solution of the chemical solution may contain 9/10 to 99/100 the total amount of silver nitrate applied for plating. It is preferable to dilute the another silver nitrate solution to have a silver nitrate concentration of about 0.01 mol/liter, prior to the application to the substrate. After the application of the another silver nitrate solution, the above-mentioned silver nitrate solution and the reducing solution of the chemical solution are simultaneously brought into contact and allowed to react on the substrate to complete formation of the silver film.

Use of the above-mentioned process allows the formation of a more uniform silver film, and particularly in a process whereby a silver film is formed by reciprocating a spray nozzle as in the prior art. Although the occurrence of geometric film thickness unevenness accompanying movement of the spray nozzle may become a problem at the microscopic level, the above-mentioned process demonstrates actions and effects that significantly improve on this problem.

Although the following provides an explanation of the present invention by indicating several of its examples, the present invention is not limited to these examples.

EXAMPLES A1 TO A9, A11 TO A19, A21–26 AND A31–A39

The effects of the additive on silver coating efficiency, compactness of the silver film and uniformity of film thickness were measured and observed.

(Silver Film Formation Conditions)

A substrate, namely a clean glass substrate, was transported on a conveyor with silvering test equipment and after pretreatment with a hydrochloric acid acidified stannous chloride solution, a pair of spray guns were reciprocated in the direction of width and a silver nitrate solution and a reducing solution of the invention were respectively sprayed from the ends of nozzles onto the glass substrate allowing the solutions to react and form a silver film. The reaction time was set at 40 seconds and test samples were obtained after allowing that amount of time to pass followed by washing and drying.

The silver film formation conditions are as listed below.

Glass substrate transport rate: 4.0 m/minute

Glass substrate temperature: 23±1° C.

Pretreatment: Contact with stannous chloride solution

Silver film formation:

Silver nitrate solution discharge rate: 131 $cc/m^2$

Reducing solution discharge rate: 131 $cc/m^2$

Furthermore, the composition of the chemical solution for forming a silver film consisted of the following four cases.

Case 1: Examples A1 to A9 (Case of Mixing Additive (Bismuth Nitrate) into Silver Nitrate Solution)

A) Silver Nitrate Solution 12 g of silver nitrate and 21 mL of 28 wt % ammonium hydroxide were contained in a total of 1000 mL of aqueous solution followed by the addition of bismuth nitrate as additive over the range of 0–200 mg, as shown in Table 1.

B) Reducing Solution 0.015 mol of sodium gluconate and 8.4 g of sodium hydroxide were contained in a total of 1000 mL of aqueous solution.

Case 2: Examples A11 to A19 (Case of Mixing Additive (Bismuth Nitrate) into Reducing Solution)

A) Silver Nitrate Solution 12 g (0.07 mol) of silver nitrate and 21 mL of 28 wt % ammonium hydroxide were contained in a total of 1000 mL of aqueous solution.

B) Reducing Solution 0.015 mol of sodium gluconate and 8.4 g of sodium hydroxide were contained in a total of 1000 mL of aqueous solution followed by the addition of bismuth nitrate as additive over the range of 0–200 mg, as shown in Table 2. In fact, Example A11 is identical with Example A1.

Case 3: Examples A21 to A26 (Case of Mixing Additive (Various Bismuth Compounds) into Reducing Solution A) Silver Nitrate Solution 12 g (0.07 mol) of silver nitrate and 21 mL of 28 wt % ammonium hydroxide were contained in a total of 1000 mL of aqueous solution.

B) Reducing Solution 0.015 mol of sodium gluconate and 8.4 g of sodium hydroxide were contained in a total of 1000 mL of aqueous solution followed by the individual addition of 20 mg of bismuth nitrate, bismuth acetate, bismuth hydroxide, bismuth carbonate, bismuth sulfate and bismuth sulfide as the additive, as shown in Table 3.

Case 4: Examples A31 to A39 (Case of Mixing Additive (Various Metal Compounds) into Reducing Solution)

A) Silver Nitrate Solution 12 g (0.07 mol) of silver nitrate and 21 mL of 28 wt % ammonium hydroxide were contained in a total of 1000 mL of aqueous solution.

B) Reducing Solution 0.015 mol of D-glucose as reducing agent, and sodium hydroxide over a range of 0–8.4 g were contained in 1000 mL of aqueous solution (pH of the reducing solution: 6–13) followed by the individual addition of 20 mg of bismuth nitrate, aluminum sulfate and iron sulfate as the additive, as shown in Table 4.

(Test and Measurement Methods)

Silver films were formed from the above-mentioned chemical solution compositions under the above-mentioned conditions, and the following tests were performed on the resulting samples.

Measurement of Silver Plating Efficiency: The plated weight percentage was determined from the ratio of amount of silver plated/amount of silver supplied, as calculated from silver film thickness. The results are shown in Tables 1–4.

Observation of Silver Plating State: The plating state of the silver (fineness and compactness) was observed using a scanning electron microscope. The results are shown in Tables 1–3. For examples, as shown in Table 1, the plating state of the silver of each of Examples A2 to A9 was compared with that of Example A1 as standard.

Observation of Film Thickness Unevenness: Light was shone from the back of the glass substrate, on which the silver film was deposited, in a dark room, followed by observation of film thickness unevenness according to the transmitted light. The results are shown in Tables 1–3. For example, as shown in Table 1, the film thickness unevenness of each of Examples A2 to A9 was compared with that of Example A1 as standard.

Furthermore, in Case 4 (Table 4), differences between plating efficiency in the case of adding the additive and that in the case of not adding the additive (difference in wt %) were determined and shown in the table.

TABLE 1

| No. of Examples | Type of Additive | Solution to which Additive Added | Amount of Additive mg*1 | Plating Efficiency wt %*2 | Observation of Plating State*3 | Film Thickness Uneveness*4 |
|---|---|---|---|---|---|---|
| A1 | None | — | 0 | 38 | Standard | Standard |
| A2 | Bismuth nitrate | Silver Nitrate solution | 5 | 40 | More compact than A1 | More uniform than A1 |
| A3 | Same as above | Same as above | 10 | 43 | More compact than A1 | More uniform than A1 |
| A4 | Same as above | Same as above | 20 | 49 | More compact than A1 | More uniform than A1 |
| A5 | Same as above | Same as above | 40 | 56 | More compact than A1 | More uniform than A1 |
| A6 | Same as above | Same as above | 80 | 50 | Equal to A1 | More uniform than A1 |
| A7 | Same as above | Same as above | 100 | 45 | Equal to A1 | Same level as A1 |
| A8 | Same as above | Same as above | 120 | 39 | More voids than A1 | Same level as A1 |
| A9 | Same as above | Same as above | 200 | 28 | More voids than A1 | Less uniform than A1 |

TABLE 1-continued

| No. of Examples | Type of Additive | Solution to which Additive Added | Amount of Additive mg*1 | Plating Efficiency wt %*2 | Observation of Plating State*3 | Film Thickness Uneveness*4 |
|---|---|---|---|---|---|---|

*1: Amount added per 0.1 mol of silver nitrate
*2: Amount of silver plated/amount of silver supplied
*3: Observation of silver plating state (fineness and compactness) using a scanning electron microscope
*4: Observation of film thickness unevenness based on transmitted light in a dark room

TABLE 2

| No. of Examples | Type of Additive | Solution to which Additive Added | Amount of Additive mg*1 | Plating Efficiency wt %*2 | Observation of Plating State*3 | Film Thickness Uneveness*4 |
|---|---|---|---|---|---|---|
| A11 | None | — | 0 | 38 | Standard | Standard |
| A12 | Bismuth nitrate | Reducing Solution | 5 | 42 | More compact than A11 | More uniform than A11 |
| A13 | Same as above | Same as above | 10 | 49 | More compact than A11 | More uniform than A11 |
| A14 | Same as above | Same as above | 20 | 57 | More compact than A11 | More uniform than A11 |
| A15 | Same as above | Same as above | 40 | 51 | More compact than A11 | More uniform than A11 |
| A16 | Same as above | Same as above | 80 | 43 | Equal to A11 | Same level as A11 |
| A17 | Same as above | Same as above | 100 | 40 | Equal to A11 | Same level as A11 |
| A18 | Same as above | Same as above | 120 | 29 | More voids than A11 | Less uniform than A11 |
| A19 | Same as above | Same as above | 200 | 12 | More voids than A11 | Less uniform than A11 |

*1: Amount added per 0.1 mol of silver nitrate
*2: Amount of silver plated/amount of silver supplied
*3: Observation of silver plating state (fineness and compactness) using a scanning electron microscope
*4: Observation of film thickness unevenness based on transmitted light in a dark room

TABLE 3

| No. of Examples | Type of Additive | Solution to which Additive Added | Amount of Additive mg*1 | Plating Efficiency wt %*2 | Observation of Plating State*3 | Film Thickness Uneveness*4 |
|---|---|---|---|---|---|---|
| A21 | Bismuth nitrate | Reducing solution | 20 | 57 | Standard | Standard |
| A22 | Bismuth acetate | Same as above | 20 | 55 | Equal to A21 | Equal to A21 |
| A23 | Bismuth hydroxide | Same as above | 20 | 56 | Equal to A21 | Equal to A21 |
| A24 | Bismuth carbonate | Same as above | 20 | 53 | Equal to A21 | Equal to A21 |

TABLE 3-continued

| No. of Examples | Type of Additive | Solution to which Additive Added | Amount of Additive mg*1 | Plating Efficiency wt %*2 | Observation of Plating State*3 | Film Thickness Uneveness*4 |
|---|---|---|---|---|---|---|
| A25 | Bismuth sulfate | Same as above | 20 | 54 | Equal to A21 | Equal to A21 |
| A26 | Bismuth sulfide | Same as above | 20 | 51 | Equal to A21 | Equal to A21 |

*1: Amount added per 0.1 mol of silver nitrate
*2: Amount of silver plated/amount of silver supplied
*3: Observation of silver plating state (fineness and compactness) using a scanning electron microscope
*4: Observation of film thickness unevenness based on transmitted light in a dark room

TABLE 4

| Amt. of Sodium Hydroxide in Reducing Solution (pH) | Change in Plating Efficiency (Difference Between Plating Efficiency with Additive and Plating Efficiency Without Additive (Difference in wt %) | | |
|---|---|---|---|
| | Addition of Bismuth Nitrate* [Ex. No.] | Addition of Aluminum Sulfate* [Ex. No.] | Addition of Iron Sulfate* [Ex. No.] |
| 8.4 g/1000 mL (13) | [A31] + 11 | [A34] ± 0 | [A37] ± 0 |
| 0.8 g/1000 mL (12) | [A32] + 12 | [A35] ± 0 | [A38] + 5 |
| 0 g/1000 mL (6) | [A33] + 6 | [A36] + 4 | [A39] + 6 |

*Amount added was 20 mg/0.1 mol of silver nitrate in all cases (Test Results)

As shown in Table 1, plating efficiency of 40 wt % or more was obtained when the amount of bismuth nitrate added to the silver nitrate solution was within the range of 5–100 mg. This level of plating efficiency exceeded that of the case of non-addition (Example A1). In addition, the state of silver plating (film compactness) and uniformity of the film thickness were both equal to or greater than the case of non-addition. Namely, the amount of bismuth nitrate added is preferably within the range of 5–100 mg, more preferably within the range of 20–80 mg, and particularly preferably about 40 mg, per 0.1 moles of silver nitrate.

As shown in Table 2, plating efficiency of 40 wt % or more was obtained when the amount of bismuth nitrate added to the reducing solution was within the range of 5–100 mg. This level of plating efficiency exceeded that of the case of non-addition (Example A11). In addition, the state of silver plating (film compactness) and uniformity of the film thickness were both equal to or greater than the case of non-addition. Namely, the amount of bismuth nitrate added is preferably within the range of 5–100 mg, more preferably within the range of 10–40 mg, and particularly preferably about 20 mg, per 0.1 moles of silver nitrate.

Furthermore, although addition of bismuth nitrate to the reducing solution rather than the silver nitrate solution demonstrates greater economic feasibility since favorable results were obtained with a smaller amount, the reason for this has not been adequately determined.

As shown in Table 3, plating efficiency can be seen to be roughly equal at 51–57 wt % even when the type of additive (bismuth compound) was changed. This is because all of the bismuth compounds added demonstrate similar effects as a result of forming $Bi(OH)_3$ colloid in solution.

As shown in Table 4, the addition of bismuth nitrate improved plating efficiency at all pH values (pH 6, 12 and 13) as compared with the case of non-addition. For example, according to Example A31, the plating efficiency has improved by the addition of bismuth nitrate by 11 wt % at pH 13, relative to the case of non-addition. Addition of aluminum sulfate improved plating efficiency at pH 6, while addition of iron sulfate improved plating efficiency at pH 6 and pH 12. Thus, bismuth nitrate can be seen to have the effect of increasing plating efficiency at all pH levels examined, while aluminum sulfate and iron sulfate can be seen to have the effect of increasing plating efficiency at limited pH levels as compared with bismuth nitrate.

In the silver mirror reaction, solutions are typically used that have a pH of around 13, and in the case of such solutions, compounds containing Bi(III) ion like bismuth nitrate would be particularly effective.

Example B

In a first step, a silver nitrate solution only was sprayed onto a glass substrate, and in a second step, a silver nitrate solution and a reducing solution of the invention were sprayed to form a silver film. The sample silver film was then measured and observed for silver plating efficiency and film thickness unevenness.

(Silver Film Formation Conditions)

Using a similar procedure as that of the above-mentioned Examples A1 to A39, a clean glass substrate, was transported on a conveyor and pretreated by spraying the glass substrate with a hydrochloric acid acidified stannous chloride solution. During a first step of treatment with a chemical solution for forming a silver film, a one-tenth portion of the silver nitrate solution described below diluted 10-fold was sprayed onto the glass substrate while reciprocating a spray gun in the direction of width, followed by a second step in which the remaining amount of silver nitrate solution and a reducing solution were respectively sprayed onto the glass substrate while reciprocating a pair of spray guns in the direction of width to form a silver film that was used for the sample. The silver film formation conditions are as listed below.

Glass substrate transport rate: 4.0 m/minute

Glass substrate temperature: 23±1° C.

Pretreatment: Contact with hydrochloric acid acidified stannous chloride solution Silver film formation: Formed in two steps Furthermore, the composition of each chemical solution in the first and second steps are as shown below.

Chemical Solution Composition in First Step

Silver nitrate solution: 1.2 g (0.007 mol) of silver nitrate and 2.1 mL of 28 wt % ammonium hydroxide were contained in a total of 1000 mL of aqueous solution. The amount of silver nitrate solution sprayed per 1 square meter was 96 cc.

Chemical Solution Composition in Second Step A) Silver nitrate Solution 12 g (0.07 mol) of silver nitrate and 21 mL of 28 wt % ammonium hydroxide were contained in 1000 mL of aqueous solution. The amount of silver nitrate solution sprayed per 1 square meter was 131 cc.

B) Reducing Solution 0.015 mol of sodium gluconate, 8.4 g of sodium hydroxide and 20 mg of bismuth nitrate (per 0.1 mol of silver nitrate) as additive were added and contained in a total of 1000 mL of aqueous solution. The amount of reducing solution sprayed per 1 square meter was 131 cc.

Referential Example B

In this reference example, the silver nitrate solution was not separated. Thus, the spraying of silver nitrate solution only in the first step was omitted. The remaining treatment was performed in the same manner as Example B to form a silver film.

(Test Method)

Silver plating efficiency was measured and silver film thickness unevenness was observed in the same manner as Examples A1 to A39 for both Example B and Referential Example B. The results are shown in Table 5.

TABLE 5

| | Plating Efficiency wt %*1 | Film Thickness Unevenness*2 |
|---|---|---|
| Example B | 56 | Film thickness unevenness caused by reciprocating operation of spray guns and spotty film thickness unevenness were clearly improved as compared with Referential Example B |
| Ref. Example B | 57 | Presence of film thickness unevenness caused by reciprocating operation of spray guns<br>Conspicuous spotty film thickness unevenness |

*1: Amount of silver plated/amount of silver supplied

*2: Observation of film thickness unevenness based on transmitted light in a dark room As shown in Table 5, the plating efficiency of Example B was hardly any different from that of Referential Example B, obtaining a plating efficiency of around 55%. Furthermore, according to observation of film thickness unevenness of the silver by transmitted light, although film thickness unevenness and spotty film thickness unevenness thought to be caused by the reciprocating operation of the spray gun were observed in Reference Example B, in Embodiment B, this film thickness unevenness was considerably improved, resulting in a correspondingly higher resolution of light reflection performance.

Example C

The adhesive strength of a silver film was tested after forming a laminated silver-copper film using an authentic mirror production equipment.

(Formation of Silver Film)

A hydrochloric acid acidified stannous chloride solution used for a pretreatment agent was sprayed onto a glass substrate. During a first step of treatment with a chemical solution for forming a silver film, a one-tenth portion of a silver nitrate solution diluted 10-fold was sprayed onto the glass substrate while reciprocating a spray gun in the direction of width in the same manner as Example B, followed by a second step in which the remaining amount of silver nitrate solution and a reducing solution of the invention were respectively sprayed onto the glass substrate while reciprocating a pair of spray guns in the direction of width and controlling spraying so that the film contained 850–900 mg/m$^2$ (on the surface of the glass substrate) of silver to form a silver film.

Furthermore, the composition of each chemical solution in the first and second steps are as shown below.

Chemical Solution Composition in First Step

Silver nitrate solution: 1.2 g (0.007 mol) of silver nitrate and 2.1 mL of 28 wt % ammonium hydroxide were contained in a total of 1000 mL of aqueous solution.

Chemical Solution Composition and Configuration in Second Step

A) Silver Nitrate Solution 12 g (0.07 mol) of silver nitrate and 21 mL of 28 wt % ammonium hydroxide were contained in 1000 mL of aqueous solution.

B) Reducing Solution 0.015 mol of sodium gluconate, 8.4 g of sodium hydroxide and 20 mg of bismuth nitrate (per 0.1 mol of silver nitrate) as additive were added and contained in a total of 1000 mL of aqueous solution.

(Formation of Copper Film)

After washing the above-mentioned silver film, a reducing solution consisting primarily of iron powder and a copper solution containing copper sulfate were sprayed onto the surface of the silver film using a spray gun reciprocating in the direction of width. Furthermore, the solution conditions and spraying were controlled so that 300–350 mg/m$^2$ of copper (on the surface of the substrate) were contained. Next, after rinsing with water, the substrate was dried to obtain a copper film (protective film).

Referential Example C

For this referential example, a silver film was formed in first and second steps similar to Example C (although additive was not mixed into the chemical solution in the second step), after which a copper film (protective film) was formed in the same manner as Example C. The resulting laminated film was then compared with that of Example C.

(Adhesive Strength Test Method)

A piece of ethylene tetrafluoride tape (Chuko Chemical Industries) measuring 25×100 mm, having a thickness of 80 $\mu$m and using silicone for its adhesive was affixed onto the above-mentioned copper protective film. One end of the tape was fixed to a tensile measuring instrument, and the one end of the tape that was fixed was pulled up at a constant rate of 50 mm/min. The load required to peel the copper film from the surface of the glass substrate was measured. This load was taken to be the adhesive strength between the copper film and glass substrate. Furthermore, in Table 6, the resulting measured values were divided by the width of the tape (25 mm) to express adhesive strength per cm in units of gf/cm.

TABLE 6

| | Glass/Silver Film Adhesive Strength |
|---|---|
| Example C | 288 gf/cm |
| Referential Example C | 185 gf/cm |

In Table 6, adhesive strength between the glass substrate and copper film in the case of adding an additive (bismuth nitrate) can be seen to increase by approximately 1.5 times as compared with the case of not adding additive.

Example D

A laminated silver-copper film was formed in the same manner as Example C using an authentic mirror production equipment followed by preparing a mirror sample by forming a back coating film. A corrosion resistance test of the silver film was performed on the mirror sample by immersion in various substances and an exposure test.

(Preparation of Mirror Sample)

A laminated silver-copper film was formed in exactly the same manner as Example C. After rinsing with water and drying, an alkyd resin coating (Kawakami Paint) was applied with a flow coater so that the coating thickness after drying on the copper protective film was 50 $\mu$m. The glass substrate was then baked for 3 minutes at 120° C. to obtain the mirror samples. These samples were then subjected to various silver film corrosion resistance tests.

Referential Example D

For this referential example, a laminated silver-copper film was formed in first and second steps similar to Example C (although the additive was not added to the chemical solution for forming the silver film), after which a back coating film was formed to prepare a comparative mirror sample.

(Silver Film Corrosion Resistance Tests)

Testing was performed according to the test methods described below.

Hot Tap Water Test: Corrosion (edge curling or black edge) of the silver film occurring around the periphery of the mirror when continuously immersed for 10 days in tap water at 60° C. and then removed was measured over the maximum depth from the edge of the mirror.

Hydrochloric Acid Immersion Test: Edge curling occurring around the periphery of the mirror when continuously immersed for 72 hours in 1 wt % hydrochloric acid (reagent grade 1) at 30° C. was measured over the maximum depth.

Copper-Accelerated Acetic Acid Salt Spray (CASS) Test: Edge curling occurring around the periphery of the mirror after continuously spraying under the prescribed conditions with the prescribed concentration of CASS test solution (containing sodium chloride, cupric chloride and acetic acid and prepared to a pH of 3.0–3.1) for 240 hours based on the method stipulated in International Standard ISO 3770-1976 was measured over the maximum depth. The results of corrosion resistance testing are shown in Table 7.

TABLE 7

| | Corrosion Resistance Testing (Edge Curling Over Maximum Depth) | | |
|---|---|---|---|
| | Hot Tap Water Test | Hydrochloric Acid Immersion Test | CASS Test |
| Example D | 0.31 mm | 3.2 mm | 0.38 mm |
| Referential Example D | 0.41 mm | 7.1 mm | 0.61 mm |

(Test Results)

As shown in Table 7, the maximum depth over which corrosion occurred in the silver film of Example D was less than that of Referential Example D for all tests performed, indicating that the corrosion resistance of the silver film is improved.

The entire disclosure of Japanese Patent Application No. 11-32276 filed on Feb. 10, 1999, including specification, claims, and summary, is incorporated herein by reference in its entirety.

What is claimed is:

1. A chemical solution for forming a silver film on a substrate, said chemical solution comprising:

an ammoniac silver nitrate solution;

a separate reducing solution containing a reducing agent and a base component; and an additive containing a compound of a polyvalent metal selected from the group consisting of trivalent bismuth, trivalent aluminum, and trivalent iron, said additive being contained in at least one of the ammoniac silver nitrate solution and the reducing solution.

2. A chemical solution according to claim 1, wherein said polyvalent metal is trivalent bismuth.

3. A chemical solution according to claim 1, wherein said compound is bismuth nitrate.

4. A chemical solution according to claim 3, wherein said bismuth nitrate is contained in the reducing solution.

5. A chemical solution according to claim 1, wherein said additive is in an amount of 5–100 mg relative to 0.1 moles of silver nitrate contained in said ammoniac silver nitrate solution.

6. A chemical solution according to claim 1, further comprising another ammoniac silver nitrate solution that is free of said additive.

7. A process for forming a silver film on a substrate, using a chemical solution comprising (1) an ammoniac silver nitrate solution; (2) a separate reducing solution containing a reducing agent and a base component; and (3) an additive containing a compound of a polyvalent metal selected from the group consisting of trivalent bismuth, trivalent aluminum, and trivalent iron, said additive being contained in at least one of the ammoniac silver nitrate solution and the reducing solution, said process comprising the steps of:

(a) bringing a hydrochloric acid acidified stannous chloride solution into contact with a surface of the substrate, thereby conducting a pretreatment of the surface;

(b) bringing another ammoniac silver nitrate solution into contact with the surface of the substrate; and (c) bringing the ammoniac silver nitrate solution of the chemical solution into contact with the reducing solution, on the surface of the substrate, thereby forming the silver film thereon.

8. A process according to claim 7, wherein said polyvalent metal is trivalent bismuth.

9. A process according to claim 7, wherein said compound of said additive is bismuth nitrate.

10. A process according to claim 9, wherein said bismuth nitrate is contained in the reducing solution.

11. A process according to claim 7, wherein said another ammoniac silver nitrate solution is free of said additive.

12. A process according to claim 7, wherein the substrate is cleaned prior to the step (a) and is continuously transported during the steps (a), (b) and (c).

* * * * *